US010456818B2

(12) United States Patent
Kurz et al.

(10) Patent No.: US 10,456,818 B2
(45) Date of Patent: Oct. 29, 2019

(54) SIMPLE PRE-CONTROL OF A WEDGE-TYPE ROLL-GAP ADJUSTMENT OF A ROUGHING STAND

(71) Applicant: PRIMETALS TECHNOLOGIES GERMANY GMBH, Erlangen (DE)

(72) Inventors: Matthias Kurz, Erlangen (DE); Uwe Rietbrock, Hemhofen (DE)

(73) Assignee: PRIMETALS TECHNOLOGIES GERMANY GMBH (DE)

( * ) Notice: Subject to any disclaimer, the term of this patent is extended or adjusted under 35 U.S.C. 154(b) by 566 days.

(21) Appl. No.: 15/120,726

(22) PCT Filed: Jan. 21, 2015

(86) PCT No.: PCT/EP2015/051118
§ 371 (c)(1),
(2) Date: Aug. 22, 2016

(87) PCT Pub. No.: WO2015/124363
PCT Pub. Date: Aug. 27, 2015

(65) Prior Publication Data

US 2017/0014880 A1 Jan. 19, 2017

(30) Foreign Application Priority Data

Feb. 21, 2014 (EP) ..... 14156158

(51) Int. Cl.
*B21B 39/16* (2006.01)
*B21B 37/58* (2006.01)
(Continued)

(52) U.S. Cl.
CPC ..... *B21B 37/58* (2013.01); *B21B 1/26* (2013.01); *B21B 1/28* (2013.01); *B21B 1/463* (2013.01);
(Continued)

(58) Field of Classification Search
CPC ..... B21B 37/58; B21B 13/06; B21B 38/02; B21B 38/04; B21B 39/12; B21B 37/26;
(Continued)

(56) References Cited

U.S. PATENT DOCUMENTS 8,429,943 B2 4/2013 Jepsen et al.
8,490,447 B2 7/2013 Kurz et al.
(Continued)

FOREIGN PATENT DOCUMENTS

CN 1494465 A 5/2004
CN 1852780 A 10/2006
(Continued)

OTHER PUBLICATIONS

International Preliminary Report on Patentability dated Feb. 2, 2016 issued in corresponding International patent application No. PCT/EP2015/051118.
(Continued)

*Primary Examiner* — David B Jones
(74) *Attorney, Agent, or Firm* — Ostrolenk Faber LLP

(57) ABSTRACT

A plurality of flat metal items to be rolled (3) are fed to a plurality of rolling stands (1, 2) of a rolling installation, one after the other over a feed path (4). The items (3) are rolled by the rolling stands (1, 2) past which they are fed. In the rolling stands (1, 2), the flat item to be rolled (3) is first rough-rolled in at least one roughing pass with a wedge-type roll gap adjustment (ds) and then finish-rolled in finishing passes. After the finish-rolling of the flat item, a thickness taper (dd) that is present in the respective finish-rolled flat item is recorded by measuring instruments. The thickness taper (dd) is compared with a target taper (dZ). On the basis of a deviation of the thickness taper (dd) from the target taper (dZ) and the wedge-type roll gap adjustment (ds), a new wedge-type roll gap adjustment (ds) is determined for
(Continued)

the at least one roughing pass. The wedge-type roll gap adjustment (ds) for the at least one roughing pass for the next flat item to be rolled (3) is set to correspond to the newly determined value of the wedge-type roll gap adjustment (ds), so that the next flat item to be rolled (3) is rough-rolled in the at least one roughing pass with the newly determined value of the wedge-type roll gap adjustment (ds).

7 Claims, 3 Drawing Sheets

(51) Int. Cl.

| | |
|---|---|
| ***B21B 1/26*** | (2006.01) |
| ***B21B 37/68*** | (2006.01) |
| ***B21B 1/28*** | (2006.01) |
| ***B21B 13/22*** | (2006.01) |
| ***B21B 37/26*** | (2006.01) |
| ***B21B 1/46*** | (2006.01) |
| ***B21B 38/00*** | (2006.01) |
| ***B21B 13/06*** | (2006.01) |
| ***B21B 38/02*** | (2006.01) |
| ***B21B 38/04*** | (2006.01) |
| ***B21B 39/12*** | (2006.01) |

(52) U.S. Cl.
CPC ..... *B21B 13/06* (2013.01); *B21B 13/22* (2013.01); *B21B 37/26* (2013.01); *B21B 37/68* (2013.01); *B21B 38/00* (2013.01); *B21B 38/02* (2013.01); *B21B 38/04* (2013.01); *B21B 39/12* (2013.01); *B21B 2265/06* (2013.01); *B21B 2265/12* (2013.01); *B21B 2273/04* (2013.01); *B21B 2275/06* (2013.01)

(58) Field of Classification Search
CPC ..... B21B 1/463; B21B 13/22; B21B 2265/06; B21B 2265/12; B21B 2275/06; B21B 37/68; B21B 1/26; B21B 1/28; B21B 38/00; B21B 2273/04
USPC ..... 72/9.3
See application file for complete search history.

(56) References Cited

U.S. PATENT DOCUMENTS

| | | | | |
|---|---|---|---|---|
| 8,919,162 | B2 * | 12/2014 | Moretto | B21B 37/68 72/11.1 |
| 9,314,828 | B2 * | 4/2016 | Gruss | B21B 37/26 |
| 9,669,438 | B2 * | 6/2017 | Ito | B21C 51/00 |
| 2006/0207305 | A1 | 9/2006 | Maruyama et al. | 72/9.3 |
| 2014/0100686 | A1 | 4/2014 | Kurz | |
| 2015/0151342 | A1 | 6/2015 | Gruess et al. | 72/251 |
| 2015/0231679 | A1 | 8/2015 | Kurz et al. | |

FOREIGN PATENT DOCUMENTS

| | | | |
|---|---|---|---|
| EP | 0 884 118 | A1 | 12/1998 |
| EP | 1 344 582 | A1 | 9/2003 |
| EP | 2 666 558 | A1 | 11/2013 |
| EP | 2 689 863 | A1 | 1/2014 |
| JP | H11-10215 | | 1/1999 |
| WO | WO 2006/063948 | A1 | 6/2006 |
| WO | WO 2009/016086 | A1 | 11/2006 |
| WO | WO 2008/002254 | A1 | 1/2008 |
| WO | WO 2006/119984 | A1 | 2/2009 |
| WO | WO 2012/159849 | A1 | 11/2012 |
| WO | WO 2013/174602 | A1 | 11/2013 |

OTHER PUBLICATIONS

International Search Report dated Apr. 14, 2015 issued in corresponding International patent application No. PCT/EP2015/051118.
Written Opinion dated Apr. 14, 2015 issued in corresponding International patent application No. PCT/EP2315/051118.
Search Report dated Jul. 9, 2014 issued in corresponding European patent application No. 14 15 6158.
Office Action dated Jun. 2 2017 issued in corresponding Chinese Patent Application No. 201580009659.6 with English translation.

* cited by examiner

SIMPLE PRE-CONTROL OF A WEDGE-TYPE ROLL-GAP ADJUSTMENT OF A ROUGHING STAND

CROSS-REFERENCE TO RELATED APPLICATIONS

The present application is a 35 U.S.C. §§ 371 national phase conversion of PCT/EP2015/051118, filed Jan. 21, 2015, which claims priority of European Patent Application No. 14156158.9, filed Feb. 21, 2014, the contents of which are incorporated by reference herein. The PCT International Application was published in the German language.

TECHNICAL BACKGROUND

Glossary

Roughing, roughed and other forms of the word rough, herein refer to early passes in a rolling mill. Those passes are conducted in a roughing mill or roughing mill stand. It basically is a pre-rolling process.

Ferry herein is a transport or conveying device which transfers a slab or a pre-rolled strip to another location.

Saber is a curved or bent shape of an end of a slab or strip, bent in a lateral direction, transverse to the rolling direction. See for example US2015/231,679 A1, paragraph 5.

The present invention relates to an operating method for a rolling mill,

- wherein several first flat items of rolling stock made of metal are fed in succession to a plurality of roll stands of the rolling mill via a first feed path,
- wherein the first flat items of rolling stock are rolled by means of the plurality of roll stands,
- wherein the respective first flat item of rolling stock is firstly roughed down in the plurality of roll stands in at least one roughing pass with a first wedge setting and is then finish-rolled in finishing passes,
- wherein after the finish-rolling of the respective first flat item of rolling stock a first thickness wedge existing in the finish-rolled respective first flat item of rolling stock is registered by applied metrology,
- wherein the first thickness wedge existing in the finish-rolled respective first flat item of rolling stock is compared with a first target wedge,
- wherein on the basis of a deviation of the existing first thickness wedge from the first target wedge and from the first wedge setting a new first wedge setting for the at least one roughing pass is ascertained and
- wherein the first wedge setting in the course of the at least one roughing pass is adjusted, in accordance with the newly ascertained value of the first wedge setting, for the first flat item of rolling stock to be rolled next, so that the first flat item of rolling stock to be rolled next is roughed down in the at least one roughing pass with the newly ascertained value of the first wedge setting.

The present invention relates, moreover, to a control program for a control device of a rolling mill, wherein the control program comprises machine code that can be executed by the control device, wherein the execution of the machine code by the control device causes the control device to operate the rolling mill in accordance with an operating method of such a type.

The present invention relates, moreover, to a control device of a rolling mill, wherein the control device has been programmed with a control program of such a type.

The present invention relates, moreover, to a rolling mill,

- wherein the rolling mill exhibits a first feed path, via which several first flat items of rolling stock made of metal are fed in succession to a plurality of roll stands of the rolling mill,
- wherein the rolling mill exhibits a plurality of roll stands, by means of which the first flat items of rolling stock are rolled,
- wherein the respective first flat item of rolling stock is firstly roughed down in the plurality of roll stands in at least one roughing pass with a first wedge setting and is then finish-rolled in finishing passes,
- wherein the rolling mill includes a thickness-measuring device, by means of which, after the finish-rolling of the respective first flat item of rolling stock, a first thickness wedge existing in the finish-rolled respective first flat item of rolling stock is registered by applied metrology.

One quality feature in connection with the rolling of flat rolling stock is the size of a wedge, that is, an asymmetrical thickness distribution of the flat item of rolling stock, viewed over the width of the flat item of rolling stock. As a rule, a thickness wedge is undesirable.

Various procedures are known for avoiding or eliminating a thickness wedge.

For instance, the aforementioned subject-matters are known from JP H11-010 215 A.

From WO 2006/063948 A1 an operating method is known for a roll train with at least one roll stand for rolling a strip in several rolling operations. Within the scope of this operating method, a computer ascertains roll-stand settings on the basis of a model of the roll train for each rolling operation on the basis of input parameters of the strip that are expected for this rolling operation, and transmits these settings to the roll stand carrying out this rolling operation. The roll stand adjusts itself in accordance with the transmitted settings, and rolls the strip correspondingly. Within the scope of the model of the roll train, the computer also ascertains an exit-side thickness wedge expected in the course of this rolling operation. By means of a measuring device a measurable quantity depending on the actual exit-side thickness wedge of the strip is registered and is transmitted to the computer. On the basis of the measurable quantity and the expected exit-side thickness wedge, the computer adapts the model of the roll train. As a general rule, one of the input parameters is an entry-side thickness wedge expected in the course of the respective rolling operation.

From WO 2012/159849 A1 an operating method for a roll train with at least one roll stand for rolling a strip is likewise known. In the course of this operating method, stand parameters that describe the roll stand are specified to a control computer for the roll train. Within the scope of a pass-sequence calculation, the control computer assesses variables that describe the rolling of the flat rolling stock in the roll stand. The assessed variables, in conjunction with the stand parameters and variables that describe the flat rolling stock before the rolling in the roll stand, describe the roll gap and the asymmetry thereof that arise in the course of rolling the rolling stock in the roll stand. Within the scope of the pass-sequence calculation, the control computer ascertains, by means of a model of the roll train, an exit-side thickness wedge and/or an exit-side saber that is/are expected for the flat rolling stock in the course of the rolling in the roll stand. A wedge strategy, that is, criteria, on the basis of which the control computer can ascertain how the exit-side thickness wedge is intended to be—is specified to the control computer from outside. In accordance with the wedge strategy the control computer ascertains optimized control variables for the roll stand.

From WO 2006/119984 A1 a method for hot rolling of slabs is known, wherein the slabs are rolled out into roughed strips in at least one roughing stand. In the course of this method the geometry of the rough strip is influenced selectively, in order to reshape a saber-like or wedge-like slab into a straight and wedge-free roughed strip. Within the scope of this method, lateral guides, which can be placed against the rolling stock and by means of which transverse forces are exerted on the rolling stock in order to prevent the formation of a saber in the rolling stock, are arranged in front of and behind the roughing stand.

In particular, WO 2006/119984 A1 represents an advance, since according to the teaching of WO 2006/119984 A1 at least one straight and wedge-free roughed strip can be generated. But the teaching of WO 2006/119984 A1 results in an appreciable success only when, for other reasons, again a wedge and/or a saber is/are not imposed on the straight and wedge-free roughed strip in the finishing train.

From WO 2013/174602 A1 a configuration of the teaching of WO 2006/119984 A1 going beyond the latter is known, in which the lateral guides additionally include a roller that can be placed against the rolling stock in the transverse direction, so that a transverse force can be exerted on the rolling stock by means of the roller.

From WO 2009/016086 A1 it is known to influence the wedge-like nature of a roughed strip while maintaining the saber freedom in the course of roughing down by using edgers in conjunction with the roughing down.

SUMMARY OF THE INVENTION

The object of the present invention comprises creating possibilities by means of which a thickness wedge in the finish-rolled flat rolling stock can be avoided or at least reduced in straightforward manner, wherein a saber-type formation is also intended to be avoided at the same time.

The object is achieved by an operating method disclosed herein. Advantageous configurations of the operating method are also disclosed.

In accordance with the invention, an operating method of the aforementioned type is so configured

- that, during the roughing down of the respective first flat item of rolling stock in the roll stand, carrying out the at least one roughing pass, lateral guides and/or edgers are placed against the rolling stock in front of and/or behind this roll stand,
- that the lateral guides and/or edgers exert transverse forces on the respective first flat item of rolling stock, which prevent a saber-type formation in the course of roughing down, and
- that a change of the first wedge setting at least up to a certain limiting value of the change of the first wedge setting is proportional to the deviation of the first thickness wedge, existing in the finish-rolled respective first flat item of rolling stock, from the first target wedge.

The present invention is accordingly based, on the one hand, on the perception that it is irrelevant whether a thickness wedge deviating from the target wedge is present at intermediate stages—for example, in the roughed strip. What is decisive is merely that the target wedge is obtained in the end product—that is to say, in the flat rolling stock after the finish-rolling. On the other hand, the present invention is based on the perception that in the case where the thickness wedge does deviate from the target wedge this deviation can be counteracted for the next, not yet rolled flat item of rolling stock by appropriate setting of the roll stand in the course of roughing down. In this case, no elaborate modeling of the rolling process is required. It is sufficient if there is a tendency for the deviation of the thickness wedge from the target wedge to be counteracted. This is guaranteed by the procedure according to the invention.

The procedure according to the invention does presuppose that the results—in particular, the resultant thickness wedge—are reproducible from rolling stock to rolling stock. In practice, however, this is the case, at least within uniform flat items of rolling stock. This often holds true even when wedge settings are moved during the finish-rolling during the respective finishing passes. Wedge settings of such a type can, for example, be performed manually by an operator of the rolling mill, in order to make the travel of the strip favorable. This is because it is merely the reproducibility of the thicknesses wedge that is decisive, this reproducibility continuing to obtain also in this case.

The first target wedge may have been determined as needed. The first target wedge will often have the value zero. However, it is also possible that the first target wedge has a value different from zero.

The invention preferentially provides that the change of the first wedge setting increases monotonically with the ratio of a mean rolling-stock thickness of the respective first flat item of rolling stock after the roughing down and after the finish-rolling. As a result, it is possible to track the first wedge setting even when differing finishing-roll thicknesses are to be rolled.

The invention preferentially provides that an RAC is undertaken during the rolling of the respective first flat item of rolling stock. The term "RAC" stands for roll alignment control. Roll alignment control means that during the rolling there is a reaction to differential rolling forces arising between operating side and drive side, and/or to a lateral migrating of the rolling stock. Within the scope of the roll alignment control, an additional wedge setting of the corresponding roll stand is ascertained, in order to counteract the differential rolling forces and/or the migrating of the rolling stock. The roll alignment control is still effective during the respective rolling operation.

In the course of the rolling of flat rolling stock, in many cases several second flat items of rolling stock, in addition to the first flat items of rolling stock, are fed in succession to the plurality of roll stands via a second feed path. For example, slabs can be fed directly to a multiple-stand finishing train with upstream roughing train from, on the one hand, a continuous casting plant and, on the other hand, from a further continuous casting plant and/or via a slab stock. In such a case, the second flat items of rolling stock are also rolled by the plurality of roll stands. In this case, the respective second flat item of rolling stock in the plurality of roll stands is firstly roughed down, in a manner analogous to that for the first flat items of rolling stock, in at least one roughing pass with a second wedge setting and is then finish-rolled in finishing passes.

Here too, after the finish-rolling of the respective second flat item of rolling stock a second thickness wedge existing in the finish-rolled respective second flat item of rolling stock is registered by applied metrology. Moreover, here too, the second thickness wedge is compared with a second target wedge, and on the basis of a deviation of the second thickness wedge existing in the finish-rolled respective second flat item of rolling stock from the second target wedge and from the second wedge setting a new second wedge setting for the at least one roughing pass is ascertained. Finally, here too, the second wedge setting in the course of the at least one roughing pass for the second flat item of rolling stock to be rolled next is adjusted in accordance with the newly ascertained value of the second wedge setting, so that the second flat item of rolling stock to be rolled next is roughed down in the at least one roughing pass with the newly ascertained value of the second wedge setting. By virtue of the separate treatment of the first items of rolling stock and of the respective change of the wedge setting ascertained for these items of rolling stock, on the one hand, and of the second items of rolling stock and of the respective change of the wedge setting ascertained for these items of rolling stock, on the other hand, the optimal wedge settings can be ascertained separately for the first and second items of rolling stock.

The second target wedge may have been determined as needed. The second target wedge may, in a manner analogous to the first target wedge, often have the value zero. However, it is also possible, once again in a manner analogous to the first target wedge, that the second target wedge has a value different from zero.

The advantageous configurations that are possible with respect to the first items of rolling stock are, of course, also possible with respect to the second items of rolling stock.

The procedure can also be extended to further feed paths.

The object of the invention is achieved, moreover, by a control program. In accordance with the invention, a control program of the aforementioned type is so configured that the execution of the machine code by the control device causes the control device to operate the rolling mill in accordance with an operating method according to the invention.

The object is achieved, moreover, using a control device described herein. In accordance with the invention, a control device of the aforementioned type has been programmed with a control program according to the invention.

The object is achieved, moreover, by a rolling mill described herein. In accordance with the invention, a rolling mill of the aforementioned type is so configured that the rolling mill exhibits, in front of and/or behind the roll stand carrying out the at least one roughing pass, lateral guides and/or edgers which are placed against this roll stand during the roughing down of the respective first flat item of rolling stock and exert transverse forces on the respective first flat item of rolling stock, which prevent a saber-type formation in the course of roughing down, and that the rolling mill includes a control device according to the invention, which operates the rolling mill in accordance with an operating method according to the invention.

The properties, features and advantages of this invention that have been described above, and also the manner in which they are obtained, will become more clearly and more distinctly comprehensible in connection with the following description of the exemplary embodiments which will be elucidated in more detail in conjunction with the drawings. Shown in these drawings in schematic representation are:

DESCRIPTION OF EMBODIMENTS

Figure 1:
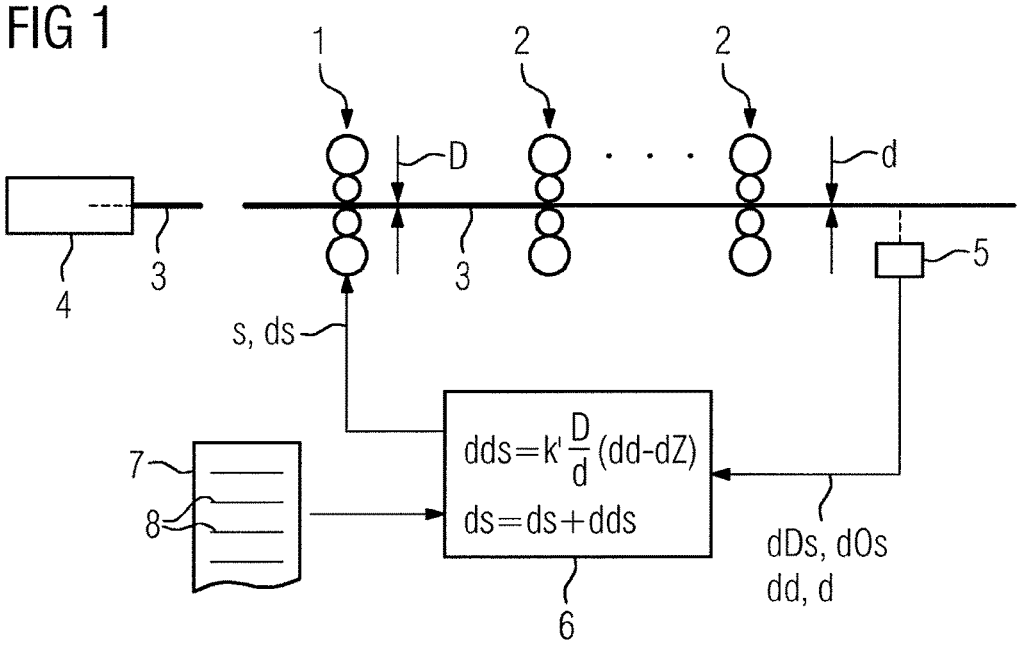
FIG. 1 is a schematic illustration of a rolling mill.

FIG. 1 shows a configuration of a rolling mill in which a single roughing stand 1 and several finishing stands 2 are present. As a rule, between four and seven finishing stands 2 are present. At least the finishing stands 2 are passed through in succession by flat items of rolling stock 3. The flat items of rolling stock 3 are rolled in the finishing stands 2 in each instance in a single roll pass (finishing pass). The flat items of rolling stock 3 consist of metal, for example steel or aluminum. However, other metals are also possible, for example copper.

In the configuration according to FIG. 1, each finishing stand 2 accordingly carries out a single roll pass. The roughing stand 1 may also carry out several roll passes (roughing passes), in an oscillating manner. The present invention will be elucidated below in conjunction with this frequently encountered configuration, that is, with a single roughing stand 1 and several finishing stands 2. The roughing stand 1 carries out several roll passes, oscillating, and each finishing stand 2 carries out a single roll pass. However, the present invention is not restricted to this configuration.

For instance, several roughing stands 1 might be present, which are passed through in succession by the flat items of rolling stock 3. In this case, it is possible that each roughing stand 1 carries out one roughing pass. Alternatively, in this case the roughing stands 1 may also be passed through by the flat items of rolling stock 3 several times, oscillating. In some cases, a single roughing stand 1 might also be present, which is passed through by the flat items of rolling stock 3 in only a single roll pass. In both cases the finishing stands 2 would continue to be passed through in succession by the flat items of rolling stock 3, each finishing stand 2 respectively carrying out a single roll pass. Moreover, in the case of several roughing passes per respective flat item of rolling stock 3, the respective flat item of rolling stock 3 is not rolled, that is, not reduced in its thickness in some of the roughing passes.

But it is also possible that only a single roll stand is present, which is passed through by the flat items of rolling stock 3 several times, oscillating. In this case, all the roll passes that is to say, both the roughing passes and the finishing passes would be carried out by the same roll stand.

The flat items of rolling stock 3 are fed in succession to the roll stands 1, 2 via a feed path defining device 4. That device 4 may, for example, take the form of a continuous casting plant with downstream equalizing furnace. Alternatively, the feed path device 4 may take the form of a ferry with a downstream furnace (for example, a tunnel furnace). The device 4 may also take the form of a slab stock with a downstream furnace. Other configurations are also possible.

After the feeding of one of the flat items of rolling stock 3 to the first roll stand 1 of the rolling mill in accordance with the configuration of FIG. 1, after the feeding to the roughing stand 1, the respective flat item of rolling stock 3 is firstly roughed down in the roll stands 1, 2 in respective roll passes. In a roughing stand 1, it is roughed by oscillating in several roughing passes. In a finishing stand 2, it is roughed in a respective finishing pass. In all cases the flat item is then finish-rolled. In particular, the roughing down in the roughing stand 1 is undertaken with a wedge setting ds of the roughing stand 1. During the respective roughing pass, the roughing stand 1 has accordingly been set in such a manner that the roll gap s of the roughing stand 1 extends in the shape of a wedge in accordance with the representation in FIG. 2, viewed over the width b of the roughing stand 1. The roll gap s of the roughing stand 1 accordingly has a wedge setting ds, the wedge setting ds being given by the relationship $$ds=sDS-sOS \quad (1)$$

In equation 1, sDS and sOS are the roll gap sDS on the drive side and the roll gap sOS on the operating side of the roughing stand 1. The wedge setting ds has been represented in FIG. 2 in distinctly exaggerated manner, for reasons of better illustration.

The wedge setting ds may be uniformly the same for all roughing passes. Alternatively, the wedge setting ds may have been determined individually from roughing pass to roughing pass. For example, the wedge setting ds of the respective roughing pass may be correlated with the exit-side nominal thickness of the respective roughing pass. In particular, it may be proportional to the exit-side nominal thickness of the respective roughing pass. Other procedures are also possible.

After the roughing passes have been carried out, the finishing passes are carried out. The respective flat item of rolling stock 3 is accordingly finish-rolled in the finishing stands 2 in the finishing passes. If required, the finishing stands 2 may have had a respective wedge setting applied to them during the execution of the respective finishing pass, for example, within the scope of the roll alignment control.

Downstream of the finishing stands 2, and more precisely, downstream of the finishing stand 2 carrying out the last finishing pass, a thickness-measuring device 5 is arranged. By means of the thickness-measuring device 5 a thickness wedge dd which is present in the finish-rolled respective flat item of rolling stock 3 is registered by applied metrology after the finish-rolling of the respective flat item of rolling stock 3. According to FIG. 3, the thickness wedge dd is expresses in a manner analogous to the wedge setting ds for example by the relationship $$dd=dDS-dOS \quad (2)$$

In Equation 2, dDS and dOS are the rolling-stock thickness dDS on the drive side and the rolling-stock thickness dOS on the operating side of the flat rolling stock 3 on the exit side of the finishing stand 2 carrying out the last finishing pass. The thickness wedge dd has been represented in FIG. 3, in a manner analogous to the wedge setting ds in a distinctly exaggerated manner, for reasons of better illustration.

It is also possible to determine the thickness wedge dd on the basis of other variables. For example, it is customary to measure the rolling-stock thicknesses dDS and dOS not directly at the lateral edges of the flat rolling stock 3 but rather at a distance from the lateral edges. The distance may amount to 25 mm or 40 mm, for example. A different sensible value may also be used by way of distance from the lateral edges. It is also possible to register the rolling-stock thickness at several places over the width of the rolling stock and to optimize, on the basis of the registered rolling-stock thicknesses, for example a parameterized description of the rolling-stock thickness as a function of location, viewed in the width direction. In this case, one of the parameters of the parameterized description, which is characteristic of the asymmetry of the rolling-stock thickness, can be drawn upon for the purpose of ascertaining the thickness wedge dd. Other procedures are also possible.

The thickness-measuring device 5 is, according to FIG. 1, connected to a control device 6 in a manner enabling transfer of data. The control device 6 has been programmed with a control program 7. The control program 7 comprises machine code 8 that can be executed by the control device 6. The execution of the machine code 8 by the control device 6 causes the control device 6 to operate the rolling mill in accordance with the operating method described above and also elucidated further below. In particular, the control device 6 controls the roll stands 1, 2 and the transport of the flat items of rolling stock 3 through the rolling mill. The control device 6 preferentially continues to implement an RAC during the rolling of the respective flat item of rolling stock 3.

Within the scope of the execution of the machine code 8 the control device 6 accepts from the thickness-measuring device 5 the measured values thereof, in particular the thickness wedge dd or the rolling-stock thicknesses dDS, dOS on the drive side and on the operating side. On the basis of the deviation of the thickness wedge dd from a target wedge dZ, where appropriate with additional utilization of further variables such as, for example, the wedge setting ds and/or a rolling-stock width, the control device 6 ascertains a change dds of the wedge setting ds. The control device 6 then changes the wedge setting ds by the change dds of the wedge setting ds. The control device 6 consequently ascertains a (new) wedge setting ds. For example, an ascertainment according to the relationship $$ds=ds+dds \quad (3)$$

can be undertaken. The newly ascertained wedge setting ds applies to the flat item of rolling stock 3 to be rolled next. The flat item of rolling stock 3 to be rolled next is accordingly roughed down in the roughing pass—generally, in the at least one roughing pass—with the new wedge setting ds—for example, according to Equation 3.

The sense and purpose of the procedure that has been elucidated is that for the flat item of rolling stock 3 to be rolled next the deviation of the thickness wedge dd from the target wedge dZ has at least a smaller value than for the last, already rolled flat item of rolling stock 3. In the optimal case, the thickness wedge dd of the flat item of rolling stock 3 rolled next is even equal to the target wedge dZ. Therefore the control device 6 ascertains the change dds of the wedge setting ds in such a manner that the change dds of the wedge setting ds counteracts the deviation.

In the simplest case, the control device 6 ascertains the change dds of the wedge setting ds in accordance with the relationship $$dds=k(dd-dZ) \quad (4)$$

In the simplest case, the change dds of the wedge setting ds is accordingly proportional to the deviation of the thickness wedge dd existing in the finish-rolled respective flat item of rolling stock 3 from the target wedge dZ. k is a suitably chosen proportionality factor in terms of absolute value and sign.

Furthermore, the change dds of the wedge setting ds preferentially increases monotonically, given identical deviation of the thickness wedge dd from the target wedge dZ, with the ratio of a mean rolling-stock thickness D, d of the respective flat item of rolling stock 3 after the roughing down and after the finish-rolling. In this connection, D is the mean rolling-stock thickness of this respective flat item of rolling stock 3 after the roughing down, d is the mean rolling-stock thickness after the finish-rolling. In the simplest case, a simple proportionality ratio is predominant. In this case, the proportionality factor k results as $$k=k'D/d \quad (5)$$

In equation 5, k' is a further proportionality factor which is independent of the two rolling-stock thicknesses D, d.

A combination of equations 4 and 5 consequently yields—see also FIG. 1—the relationship $$dds=k'D(dd-dZ)/d \quad (6)$$

For the purpose of implementing the procedure last elucidated—that is to say, the monotonic increase of the change dds of the wedge setting ds with the ratio of the mean rolling-stock thickness D, d of the respective flat item of rolling stock 3 after the roughing down and after the finish-rolling—it is necessary that the two rolling-stock thicknesses D, d are known to the control device 6. With respect to the mean rolling-stock thickness D of the respective flat item of rolling stock 3 after the roughing down, this rolling-stock thickness D may be known to the control device 6, for example by reason of the adjustment of the roughing stand 1 in the course of carrying out the last roughing pass of the respective flat item of rolling stock. With respect to the mean rolling-stock thickness d of the respective flat item of rolling stock 3 after the finish-rolling, a registration by the thickness-measuring device 5 or by a different, further thickness-measuring device, not represented in FIG. 1, is preferentially undertaken.

Figure 2:
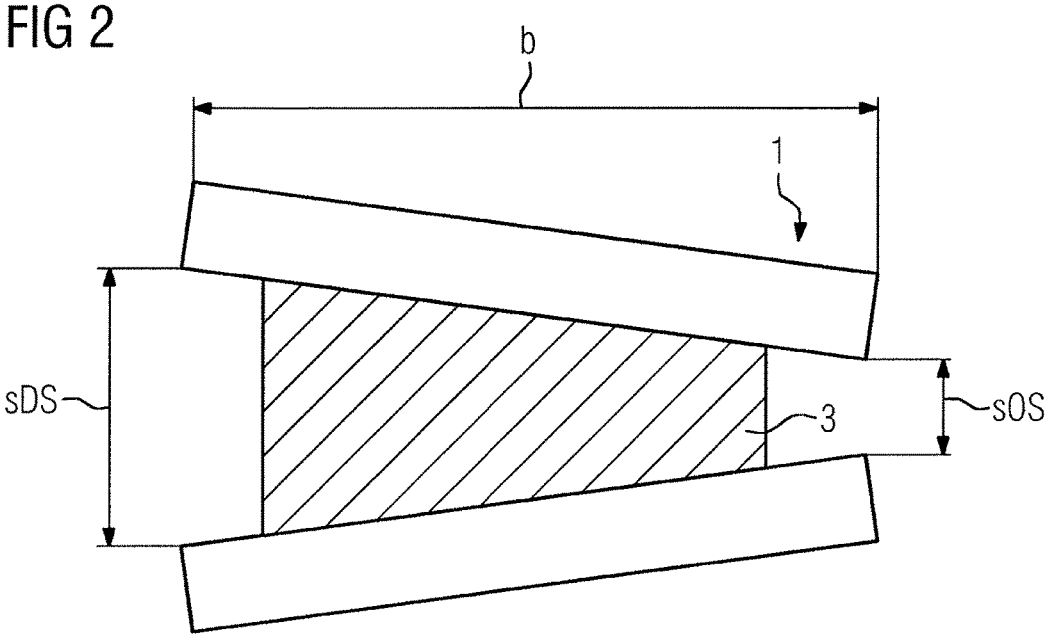
FIG. 2 shows a roll gap of a roughing stand.
Figure 3:
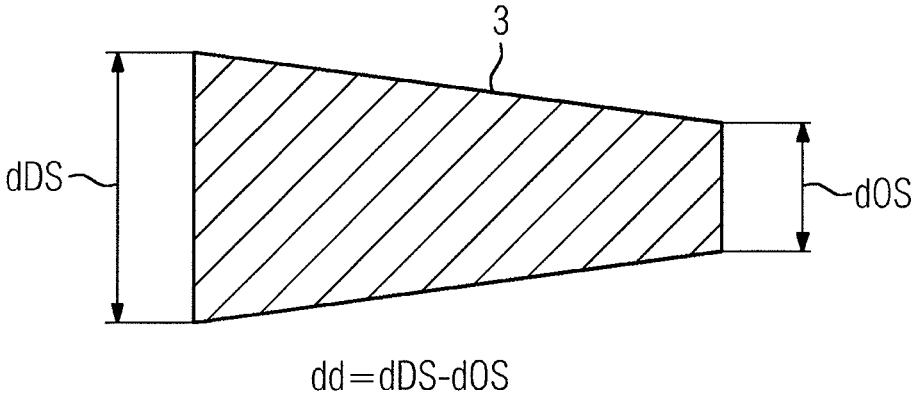
FIG. 3 shows a cross section through a flat item of rolling stock.
Figure 4:
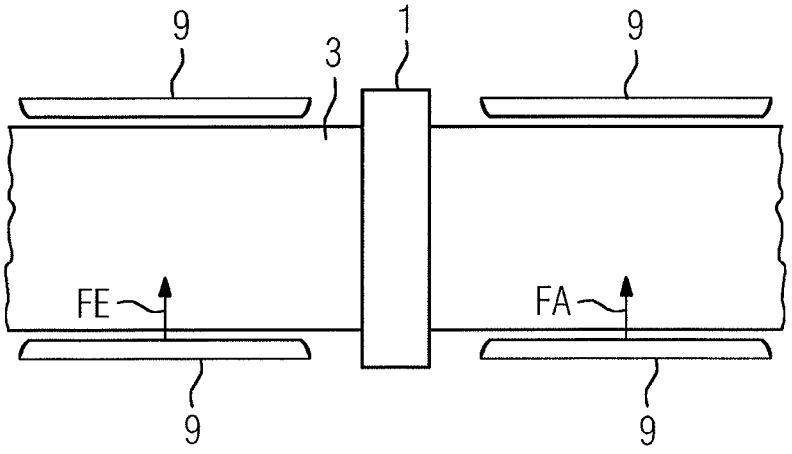
FIG. 4 shows a section of the rolling mill from above.

In accordance with the invention, the procedure elucidated above in conjunction with FIGS. 1 to 3 has, moreover, been modified in accordance with FIG. 4.

According to FIG. 4, the rolling mill additionally includes lateral guides 9. According to FIG. 4, the lateral guides 9 are arranged in front, or upstream of, or on the input side of and behind, or downstream of, or on the output side of the roughing stand 1. The lateral guides 9 are placed against the sides of the flat rolling stock 3 during the roughing down of the flat rolling stock 3. The lateral guides 9 exert transverse forces FE, FA on the flat rolling stock 3 on the input side and on the output side. The transverse forces FE, FA prevent, both on the entry side and on the output side, a saber-type formation of the flat rolling stock 3 in the course of roughing down. The lateral guides 9 may be elongated, corresponding to the representation in FIG. 4. Alternatively or additionally, the lateral guides 9 may exhibit, in a manner analogous to the procedure described in WO 2013/174602 A1—a roller or a similar element that can be placed against the respective flat item of rolling stock 3 in the transverse direction, so that by means of the roller a transverse force can be exerted on the respective flat item of rolling stock 3.

In the configuration according to FIG. 4, lateral guides 9 are arranged both upstream of and downstream of the roughing stand. In some cases it may be sufficient to arrange one lateral guide 9 only upstream of or downstream of the roughing stand 1. The respective other lateral guide 9 would not be present in this case. Moreover, it is possible to replace the anterior and/or the posterior lateral guide 9, irrespective of whether the respective other lateral guide 9 is present or not by an edger.

Figure 5:
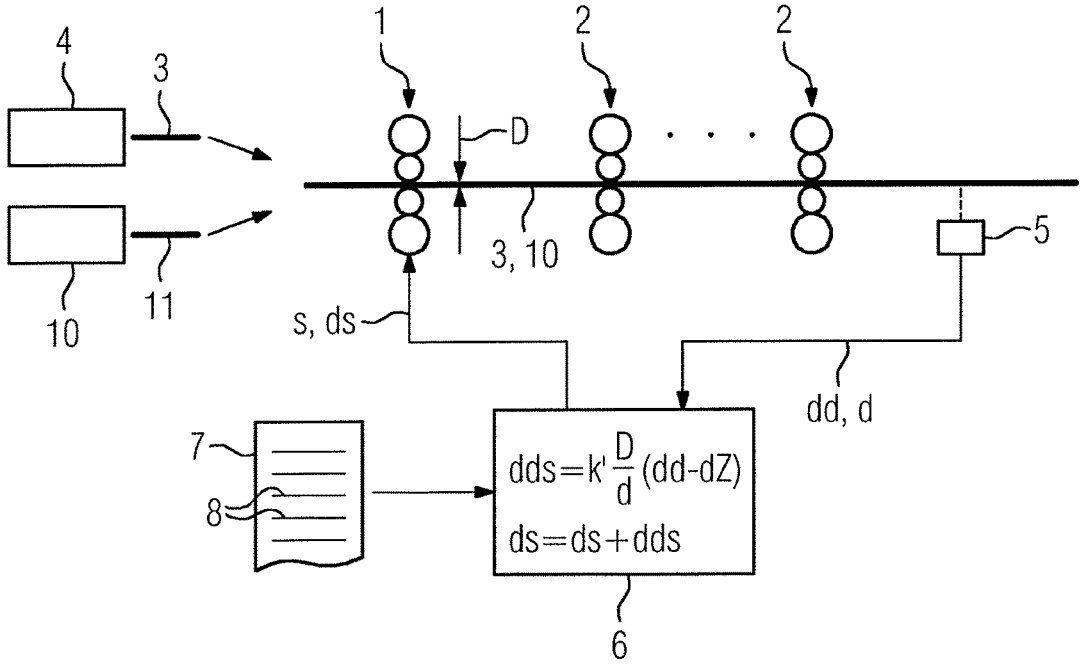
FIG. 5 shows a further rolling mill.

The configuration of the rolling mill according to FIG. 5 also corresponds, over long sections, to the configuration of the rolling mill according to FIG. 1. According to FIG. 5, however, the rolling mill includes not only the feed path 4, but also, a further feed path 10. The two feed paths 4, 10 are designated below as first feed path 4 and second feed path 10. Also via the second feed path 10, several flat items of rolling stock 11 are fed in succession to the plurality of roll stands 1, 2. The flat items of rolling stock 3, 11 fed to the roll stands 1, 2 via the respective feed path 4, 10 will be designated below as first flat items of rolling stock 3 and second flat items of rolling stock 11.

The second flat items of rolling stock 11 are rolled in the rolling mill in a manner completely analogous to that for the first items of rolling stock 3. In particular, the second flat items of rolling stock 11 are also rolled by means of the plurality of roll stands 1, 2, the respective second flat item of rolling stock 11 being firstly roughed down by means of the plurality of roll stands 1, 2 in at least one roughing pass with a respective second wedge setting ds and then being finish-rolled in finishing passes.

Moreover, also for the second flat items of rolling stock 11 after the finish-rolling of the respective second flat item of rolling stock 11 a second thickness wedge dd existing in the finish-rolled respective second flat item of rolling stock 11 is registered by applied metrology and supplied to the control device 6. The control device 6 compares the second thickness wedge dd with a second target wedge dZ and ascertains for the respective second flat item of rolling stock 11, on the basis of the deviation of the second thickness wedge dd from the second target wedge dZ and from the second wedge setting ds, a new second wedge setting ds for the at least one roughing pass. The ascertainment can be undertaken in a manner completely analogous to that for the first flat items of rolling stock 3. As also applies for the first flat items of rolling stock 3, the second wedge setting ds in the course of the at least one roughing pass for the second flat item of rolling stock 11 to be rolled next is changed. The second flat item of rolling stock 11 to be rolled next is consequently roughed down in the at least one roughing pass with the new value of the second wedge setting ds.

The crucial circumstance consequently consists in the fact that the ascertainment of the new wedge setting ds and, associated with this, the tracking of the wedge setting ds for the first and second flat items of rolling stock 3, 11 are undertaken independently of one another. Even though the first and second flat items of rolling stock 3, 11 exhibit completely different properties (for example, different chemical compositions, different temperatures, different widths, different rolling-stock thicknesses prior to roughing down, etc.), a reliable tracking of the respective wedge setting ds for the respective flat item of rolling stock 3, 11 to be rolled next can therefore be undertaken.

The distinction between the first feed path 4 and second feed path 10 can be made as needed. In the individual case, it is even possible that the flat items of rolling stock 3, 11 do in fact originate from the same source—for example, from a common slab stock—prior to being fed to the rolling mill, but pass through paths differing from one another, for example different furnaces.

The present invention impresses, above all, by virtue of its simplicity. This is because no complex modeling of the rolling mill is required. Moreover, no registration of any thickness wedge in the rolling stock 3, 11 is required before the roughing down or between the roughing down and finish-rolling. It is merely necessary to register, after the finish-rolling, the thickness wedge dd then existing in the rolling stock 3, 11, and, on the basis of this thickness wedge dd, to track the wedge setting ds of the at least one roughing pass.

Although the invention has been illustrated and described in detail by means of the preferred exemplary embodiment, the invention is not restricted by the examples disclosed, and other variations may be derived therefrom by a person skilled in the art without departing from the scope of protection of the invention.

The invention claimed is:

1. An operating method for a rolling mill processing in succession a plurality of flat items of metal rolling stock, the method comprising:

feeding a first flat item of the plurality of flat items through a plurality of roll stands of the rolling mill via a first feed path;

roughing down the first flat item in at least one stand of the plurality of roll stands during at least one roughing pass with a first value of a wedge setting then finish-rolling the roughed down first flat item in finishing passes;

registering a first thickness wedge produced for the first flat item after the finish-rolling of the first flat item;

comparing the first thickness wedge of the first flat item with a first target wedge, and determining a deviation of the first thickness wedge from the first target wedge;

based on the deviation and on the first value of the wedge setting, determining a new value of the wedge setting for the at least one roughing pass;

adjusting the wedge setting in the course of the at least one roughing pass in accordance with the new value of the wedge setting for a next flat item of the plurality of flat items to be rolled next, so that the next flat item is roughed down in the at least one roughing pass with the new value of the wedge setting; and during the roughing down of the plurality of flat item in one of the roll stands, placing lateral guides and/or edgers against the flat items in front or upstream of and/or behind or downstream of the roll stand, such that the lateral guides and/or edgers exert transverse forces on the respective flat items of rolling stock for preventing a saber-type formation in the rolling stock in the course of roughing down;

wherein the adjusting of the wedge setting is such that the wedge setting is proportional to the thickness wedge existing in the finish-rolled respective flat item.

2. The operating method as claimed in claim 1, wherein the wedge setting is adjusted such that the wedge setting increases monotonically with the ratio of a mean rolling-stock thickness of the respective flat item after the roughing down and after the finish-rolling.

3. The operating method as claimed in claim 1, further comprising controlling roll alignment during the rolling of a respective flat item.

4. The operating method as claimed in claim 1, further comprising:

feeding a second plurality of flat items of rolling stock in succession to the plurality of roll stands via a second feed path;

roughing down a first flat item of the second plurality of flat items of rolling stock by at least one roughing pass having a second value for the wedge setting, and then finish-rolling the second flat item in finishing passes;

wherein the finish-rolling of the respective second flat item of rolling stock causes a second thickness wedge to exist in the finish-rolled respective second flat item, and registering the second thickness wedge by applied metrology;

comparing the second thickness wedge with a second target wedge to calculate a deviation of the second thickness wedge from the second target wedge;

based on the deviation and on the second value of the wedge setting, determining a new value for the second wedge setting for the at least one roughing pass; and adjusting the wedge setting in the course of the at least one roughing pass for second flat item of the second plurality of flat items to be rolled next in accordance with the new value of the wedge setting, so that the next second flat item new value of the wedge setting.

5. A non-transient computer-readable medium product incorporating a computer program code configured to control a rolling mill, the program code configured, when executed by a control device, to operate the rolling mill in accordance with the operating method as claimed in claim 1.

6. A control device of a rolling mill, wherein the control device incorporates the computer program of the computer program product claimed in claim 5.

7. A rolling mill for processing a plurality of flat items of metal rolling stock, the rolling mill comprising:

the rolling mill including a first feed path, via which a plurality of first flat items of rolling stock made of metal are fed in succession to a plurality of roll stands of the rolling mill;

the rolling mill includes a plurality of roll stands configured for rolling the plurality of flat items, wherein a first flat item of the plurality of flat items is roughed down in at least one stand of the plurality of roll stands in at least one roughing pass with a first value of a wedge setting and then the first flat item is finish rolled in finishing passes;

the rolling mill including a thickness-measuring device configured to measure a thickness of the first flat item after the finish-rolling of the first flat item, wherein a first thickness wedge in the finish-rolled first flat item is registered by applied metrology;

wherein the rolling mill includes, in front or upstream of and/or behind or downstream of the roll stand, for carrying out the at least one roughing pass, lateral guides and/or edgers which, during the roughing down of the first flat item, are placed against this roll stand to exert transverse forces on the first flat item, which forces are directed and applied to prevent a saber-type formation in the course of the roughing down; and a control device configured to control operation of the rolling mill including the roll stands so as to adjust the first wedge setting in the course of the at least one roughing pass in accordance with a new value of the wedge setting, for a next flat item of the plurality of flat items to be rolled next, so that the next flat item is roughed down in the at least one roughing pass with the new value of the wedge setting, wherein the new value is determined by comparing the first thickness edge of the first flat item with a first target wedge, and determining a deviation of the first thickness wedge from the first target wedge;

based on the deviation and on the first value of the wedge setting, determining the new value of the wedge setting for the at least one roughing pass.

* * * * *